US010262793B2

(12) United States Patent
Muneuchi et al.

(10) Patent No.: US 10,262,793 B2
(45) Date of Patent: Apr. 16, 2019

(54) MANUFACTURING METHOD OF SURFACE MOUNTED INDUCTOR

(71) Applicant: Murata Manufacturing Co., Ltd., Kyoto (JP)

(72) Inventors: Keita Muneuchi, Tsurugashima (JP); Makoto Murakami, Tsurugashima (JP)

(73) Assignee: Murata Manufacturing Co., Ltd., Kyoto (JP)

( * ) Notice: Subject to any disclaimer, the term of this patent is extended or adjusted under 35 U.S.C. 154(b) by 177 days.

(21) Appl. No.: 15/407,690

(22) Filed: Jan. 17, 2017

(65) Prior Publication Data

US 2017/0125166 A1 May 4, 2017

Related U.S. Application Data

(63) Continuation of application No. PCT/JP2015/069525, filed on Jul. 7, 2015.

(30) Foreign Application Priority Data

Jul. 18, 2014 (JP) ..... 2014-147485

(51) Int. Cl.
*H01F 41/076* (2016.01)
*H01F 41/06* (2016.01)
*H01F 41/02* (2006.01)

(52) U.S. Cl.
CPC ..... *H01F 41/06* (2013.01); *H01F 41/0246* (2013.01); *H01F 41/076* (2016.01)

(58) Field of Classification Search
CPC ..... H01F 41/0246; H01F 41/06; H01F 41/076
See application file for complete search history.

(56) References Cited

U.S. PATENT DOCUMENTS

2014/0068926 A1* 3/2014 Saito ..... H01F 27/292 29/602.1

FOREIGN PATENT DOCUMENTS

| | | | | |
|---|---|---|---|---|
| JP | 11254477 | A | * | 9/1999 |
| JP | 2009-170488 | A | | 7/2009 |
| JP | 2010-147212 | A | | 7/2010 |
| JP | 2010-245473 | A | | 10/2010 |
| JP | 2011-003761 | A | | 1/2011 |
| JP | 2013-183052 | A | | 9/2013 |
| JP | 2013-211330 | A | | 10/2013 |
| JP | 2013-211331 | A | | 10/2013 |

OTHER PUBLICATIONS

An Office Action; "Notification of Preliminary Rejection," issued by the Korean Intellectual Property Office dated Oct. 27, 2017, which corresponds to Korean Patent Application No. 10-2017-7001309 and is related to U.S. Appl. No. 15/407,690.

(Continued)

*Primary Examiner* — Carl J Arbes
(74) *Attorney, Agent, or Firm* — Studebaker & Brackett PC

(57) ABSTRACT

A manufacturing method of a surface mounted inductor involves using a coil and a tablet in a molding die. The coil is placed on the tablet. The coil and the tablet are arranged in the molding die and pressurized and compressed to the size of the cavity in the molding die at a first temperature. The coil and the tablet are pressurized in the molding die at a second temperature higher than the first temperature to form a formed body incorporating the coil.

12 Claims, 8 Drawing Sheets

(56) References Cited

OTHER PUBLICATIONS

International Search Report issued in PCT/JP2015/069525; dated Sep. 29, 2015.
Written Opinion issued in PCT/JP2015/069525; dated Sep. 29, 2015.
An Office Action; "Notice of Reasons for Rejection," mailed by the Japanese Patent Office dated Sep. 27, 2016, which corresponds to Japanese Patent Application No. 2014-147485 and is related to JP2013-211331 & JP2011-003761; with English language Concise Explanation.
Notification of the First Office Action issued by the State Intellectual Property Office of the People's Republic of China dated Oct. 30, 2017, which corresponds to Chinese Patent Application No. 201580039121.X and is related to U.S. Appl. No. 15/407,690.

* cited by examiner

MANUFACTURING METHOD OF SURFACE MOUNTED INDUCTOR

CROSS REFERENCE TO RELATED APPLICATION

This application claims benefit of priority to Japanese Patent Application 2014-147485 filed Jul. 18, 2014, and to International Patent Application No. PCT/JP2015/069525 filed Jul. 7, 2015, the entire content of which is incorporated herein by reference.

TECHNICAL FIELD

The present disclosure relates to a manufacturing method of a small surface mounted inductor.

BACKGROUND

Surface mounted inductors having wire wound coils in cores are widely used. Accompanied by recent miniaturization or reduction in thickness of electronic devices such as mobile phones, miniaturization or low profile is demanded also in electronic components such as surface mounted inductors. The applicant proposed, in the previously filed JP 2010-245473 A, a small surface mounted inductor using a coil obtained by spirally winding a rectangular conductive wire so that both of its ends are led out to an outer periphery and a preformed tablet, and a manufacturing method thereof.

In the manufacturing method of a surface mounted inductor described in JP 2010-245473 A, first, a sealing material containing a resin and a filler is preformed into a shape with pillar-shaped convex portions on a plate-shaped peripheral edge to prepare a tablet. Next, a coil is prepared by winding a conductive wire which is rectangular in cross section, and the coil is placed on the tablet. At this time, lead-out ends of the coil are placed so as to be along the pillar-shaped convex portions of the tablet. Then, the coil and the tablet are arranged in a molding die so that a lead-out end of the coil is interposed between an outer side surface of a pillar-shaped convex portions of the tablet and an inner wall surface of the molding die, and further the preformed sealing material is loaded into the molding die. Subsequently, the coil and the sealing material are integrated by a compression molding method or a powder compacting method in a state in which the lead-out end of the coil is interposed between the outer side surface of the pillar-shaped convex portions of the tablet and the inner wall surface of the molding die, to obtain a formed body. Lastly, as shown in FIG. 13, external electrodes 38, which are connected to portions of the lead-out ends of the coil 31 which are at least partially exposed on surfaces of a formed body 37, are provided on the surfaces or outer peripheries of the formed body.

As described above, in the method of JP 2010-245473 A, the sealing material containing the resin and the filler is preformed into the tablet with the pillar-shaped convex portions on the planar-shaped peripheral edge. In particular, considering positioning of the coil, as shown in FIG. 14, it is desired that a tablet 32 is formed into a shape with pillar-shaped convex portions 32*a* surrounding a coil 31. However, when attempting to obtain a surface mounted inductor having a size of two square millimeters or less, the size of the tablet also becomes small, and there is no choice but to reduce the thickness of the pillar-shaped convex portions. In the tablet formed with a sealing material containing a resin and a filler (in particular, those having a filler content of 60 vol % or more), when it is preformed into a complicated shape like having pillar-shaped convex portions, it becomes difficult to secure sufficient mechanical strength. When the mechanical strength of the tablet deteriorates, a defect or damage of a part of the tablet is liable to occur during carriage or loading into the molding die. When a defect or damage of a part of the tablet occurs, misalignment of the inside coil or forming failure occurs so that there is a possibility of causing characteristic failure or variation of inductors. Therefore, a certain degree of thickness had to be secured for the pillar-shaped convex portions of the tablet. When the thickness of the pillar-shaped convex portions of the tablet is secured in a state in which the shape is miniaturized, the coil shape becomes small, so that the characteristics of the inductor such as a DC resistance and a DC superimposed characteristic deteriorate. Therefore, there was a limit to the miniaturization or low profile in the method of JP 2010-245473 A.

In order to solve such a problem, as shown in FIG. 15, it is considered as follows: A coil 41 formed by winding a winding wire is housed in a molding die consisting of a lower die 45 and an upper die 44. Lead-out ends 41*b* of the coil 41 are held by the lower die and the upper die. A sealing material containing a resin and a filler is filled into the molding die so that they are pressurized using the die and a punch (for example, JP 2009-170488 A).

However, in such a case, it is required to provide a mechanism for holding the lead-out ends of the coil in the molding die and therefore the molding die becomes expensive. Also, the sealing material leaks from a portion where a lead-out end of the coil in the molding die is held, so that large burrs were likely to occur. Furthermore, when the conductive wire forming the coil is thickened, the distance between the molding die and the coil is reduced, and the filler does not penetrate resulting in the problem of deterioration of the characteristics.

SUMMARY

One or more embodiments of the present disclosure are to provide a manufacturing method of a surface mounted inductor which can reduce a DC resistance and which can improve a DC superimposed characteristic even if the surface mounted inductor is miniaturized.

One or more embodiments of the present disclosure provide a manufacturing method of a surface mounted inductor obtained by sealing a coil with a sealing material containing a resin and a filler using a molding die, the method comprising:

a first step in which, using a coil formed by winding a conductive wire so that lead-out ends are positioned at an outer periphery of a wound portion, and a tablet having a positioning mechanism and formed so that a size in one direction perpendicular to a winding axis of the coil is larger than a cavity in the molding die, the coil is placed on the tablet, the coil and the tablet are arranged in the molding die so that a lead-out end of the coil is placed along an outer side surface of the tablet to be interposed between the outer side surface of the tablet and an inner wall surface of the molding die, and a portion of the tablet, which is formed larger than the cavity in the molding die, is pressurized and compressed to the size of the cavity in the molding die at a first temperature; and a second step in which the coil and the tablet are pressurized in the molding die at a second temperature higher than the first temperature to form a formed body incorporating the coil.

One or more embodiments of the present disclosure provide a manufacturing method of a surface mounted inductor obtained by sealing a coil with a sealing material containing a resin and a filler using a molding die, the method comprising:

a first step in which, using a coil formed by winding a conductive wire so that lead-out ends of the coil are positioned at an outer periphery of a wound portion, and a tablet having a positioning mechanism and formed so that a distance between two side surfaces, which are each perpendicular to a side surface from which a lead-out end of the coil is led out, as well as each parallel to a winding axis, is larger than a cavity in the molding die, the coil is placed on the tablet, the coil and the tablet are arranged in the molding die so that the lead-out end of the coil is placed along an outer side surface of the tablet to be interposed between the outer side surface of the tablet and an inner wall surface of the molding die, and the two side surfaces of the tablet, which are each perpendicular to the side surface from which the lead-out end of the coil is led out, as well as each parallel to the winding axis, are pressurized at a first temperature so that the distance between the two side surfaces, which are each perpendicular to the side surface from which the lead-out end of the coil is led out, as well as each parallel to the winding axis, is compressed to the size of the cavity in the molding die; and a second step in which the coil and the tablet are pressurized in the molding die at a second temperature higher than the first temperature to form a formed body incorporating the coil.

One or more embodiments of the present disclosure comprise:

a first step in which, using a coil formed by winding a conductive wire so that its lead-out ends are positioned at an outer periphery of a wound portion, and a tablet having a positioning mechanism and formed so that a size in one direction perpendicular to a winding axis of the coil is larger than a cavity in the molding die, the coil is placed on the tablet, the coil and the tablet are arranged in the molding die so that a lead-out end of the coil is placed along an outer side surface of the tablet to be interposed between the outer side surface of the tablet and an inner wall surface of the molding die, and a portion of the tablet, which is formed larger than the cavity in the molding die, is pressurized and compressed to the size of the cavity in the molding die at a first temperature; and a second step in which the coil and the tablet are pressurized in the molding die at a second temperature higher than the first temperature to form a formed body incorporating the coil.

Therefore, even if it is miniaturized, the direct current resistance can be reduced, and the direct current superimposed characteristic can be improved.

One or more embodiments of the present disclosure comprise:

a first step in which, using a coil formed by winding a conductive wire so that lead-out ends of the coil are positioned at an outer periphery of a wound portion, and a tablet having a positioning mechanism and formed so that a distance between two side surfaces, which are each perpendicular to a side surface from which a lead-out end of the coil is led out, as well as each parallel to a winding axis, is larger than a cavity in the molding die, the coil is placed on the tablet, the coil and the tablet are arranged in the molding die so that the lead-out end of the coil is placed along an outer side surface of the tablet to be interposed between the outer side surface of the tablet and an inner wall surface of the molding die, and the two side surfaces of the tablet, which are each perpendicular to the side surface from which the lead-out end of the coil is led out, as well as each parallel to the winding axis, are pressurized at a first temperature so that the distance between the two side surfaces, which are each perpendicular to the side surface from which the lead-out end of the coil is led out, as well as each parallel to the winding axis, are compressed to the size of the cavity in the molding die; and a second step in which the coil and the tablet are pressurized in the molding die at a second temperature higher than the first temperature to form a formed body incorporating the coil. Therefore, even if it is miniaturized, the direct current resistance can be reduced, and the direct current superimposed characteristic can be improved.

DETAILED DESCRIPTION

Figure 1:
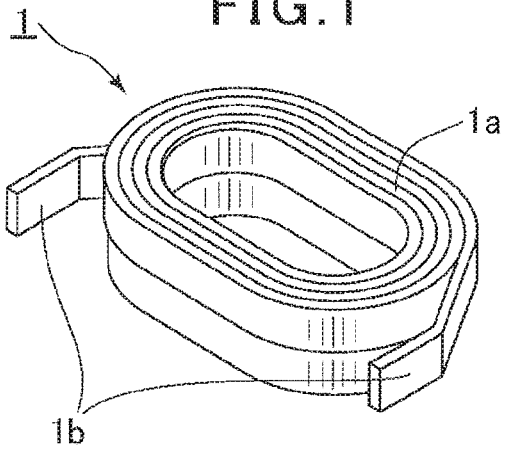
FIG. 1 is a perspective view of a coil used for an embodiment of a manufacturing method of a surface mounted inductor according to the present disclosure.

One or more embodiments of the present disclosure use a coil formed by winding a conductive wire so that both of its lead-out ends are positioned at an outer periphery of a wound portion, and a tablet formed with a sealing material containing a resin and a filler, having a positioning mechanism, and formed so that a distance between two side surfaces of the tablet, which are each perpendicular to a side surface from which a lead-out end of the coil is led out, as well as each parallel to a winding axis, is larger than a cavity in a molding die. First, the coil is placed on the tablet, and the coil and the tablet are arranged in the molding die so that the lead-out end of the coil is placed along an outer side surface of the tablet to be interposed between the outer side surface of the tablet and an inner wall surface of the molding die. Next, two side surfaces of the tablet on which the coil is placed, or of each of a first tablet on which the coil is placed and a second tablet placed on the first tablet are pressurized and compressed to the size of the cavity in the molding die at a first temperature. The two side surfaces thereof are each perpendicular to the side surface from which the lead-out end is led out, as well as each parallel to the winding axis. Furthermore, another tablet is placed on the tablet on which the coil is placed and which has been pressurized, and these tablets or the compressed first and second tablets are pressurized in the molding die at a second temperature higher than the first temperature to form a formed body incorporating the coil.

Therefore, in one or more embodiments of the present disclosure, using the tablet having the positioning mechanism and formed so that the size in one direction perpendicular to the winding axis of the coil is larger than the cavity in the molding die, this is arranged in the cavity of the molding die, and a portion of the tablet, which is formed larger than the cavity in the molding die, is pressurized to the size of the cavity in the molding die. Therefore, the tablet whose size in one direction perpendicular to the winding axis of the coil is larger than the cavity in the molding die can be housed in the cavity of the molding die. Despite the use of the tablet, the thickness between the coil and the two side surfaces, which are each perpendicular to the side surface from which the lead-out end of the coil of the formed body is led out, as well as each parallel to the winding axis, can be reduced more than before. Thereby the coil size can be made larger for that.

In one or more embodiments of the present disclosure, when the portion of the tablet, which is formed larger than the cavity in the molding die, is pressurized and compressed to the size of the cavity in the molding die, heat at a temperature of about 60 to 130° C., for example, is applied. Therefore, the tablet and coil hardly lose their shapes, and the thickness between the coil and the two side surfaces, which are each perpendicular to the side surface from which the lead-out end of the coil of the formed body is led out, as well as each parallel to the winding axis, can be reduced more than before.

The best mode for carrying out the present disclosure will hereinafter be described with reference to FIG. 1 through FIG. 12.

Figure 2:
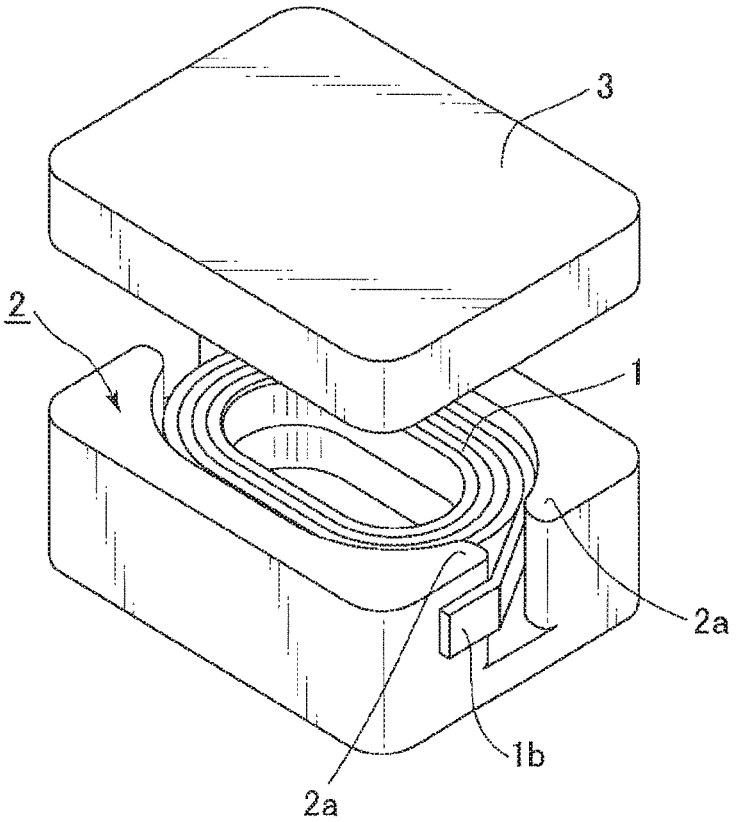
FIG. 2 is a perspective view showing the arrangement of a coil, a tablet and a plate-shaped tablet in the embodiment of the manufacturing method of a surface mounted inductor according to the present disclosure.

FIG. 1 is a perspective view of a coil used for an embodiment of a manufacturing method of a surface mounted inductor of the present disclosure, and FIG. 2 is a perspective view showing the arrangement of the coil, a tablet, and a plate-shaped tablet in the embodiment of the manufacturing method of a surface mounted inductor of the present disclosure.

In FIG. 1 and FIG. 2, the reference numeral 1 denotes the coil, and the reference numerals 2, 3 denote the tablets.

As shown in FIG. 1, the coil 1 is obtained by winding a rectangular wire in two-tiers in an outside-to-outside manner so that both of its ends are at the outermost periphery thus forming a wound portion 1*a*. Both the ends of the rectangular wire are used as lead-out ends 1*b* of the coil 1. The lead-out ends 1*b* are led out so as to be opposite to each other across the wound portion la.

Using a sealing material containing a resin and a filler, the tablets 2, 3 are formed by pressure molding. As the sealing material, those obtained by mixing iron-based metal magnetic powder and an epoxy resin are used. Furthermore, for enhancing the strength, the tablet 2 may further be heat treated so that the sealing material is in a semi-cured state.

As shown in FIG. 2, the tablet 2 has two pillar-shaped convex portions 2*a* on a peripheral edge of a planar portion so as to surround the coil 1. The tablet 2 is formed so that a distance between two side surfaces, which are each perpendicular to a side surface from which a lead-out end 1*b* of the coil 1 is led out, as well as each parallel to a winding axis, is larger than a cavity in a molding die described below. The tablet 3 is formed into a flat plate shape.

The wound portion 1*a* of the coil 1 is housed in a portion surrounded by the pillar-shaped convex portions 2*a* of the tablet 2, and both the lead-out ends 1*b* are placed so as to be along outer side surfaces of the pillar-shaped convex portions 2*a*. On the tablet 2 on which the coil 1 is placed, the tablet 3 is placed in a manner so as to cover the coil 1.

First Embodiment

Figure 3:
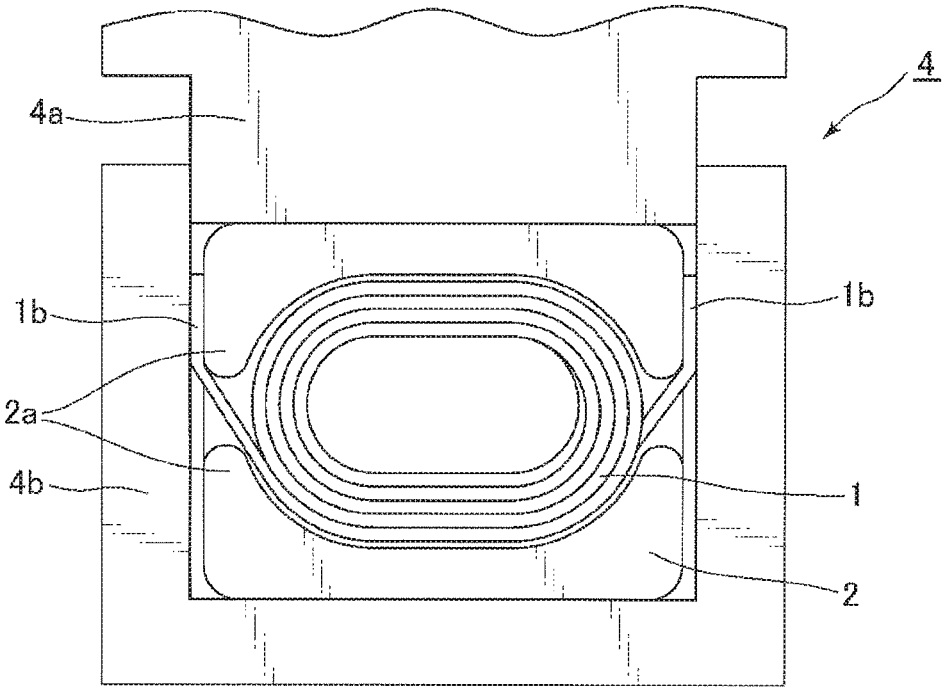
FIG. 3 is a top view showing the arrangement of a coil and a tablet in a molding die of a first embodiment of the manufacturing method of a surface mounted inductor of the present disclosure.

Such a surface mounted inductor is manufactured in the following manner. In the present embodiment, a molding die is used, in which a die 4 consisting of a sectional die 4*a* and a sectional die 4*b*, and a lower die 5, form a cavity, and which has a punch 6 to be inserted into the cavity. First, in a state in which the sectional die 4*a* is removed or in a state in which the sectional die 4*a* is loosened as shown in FIG. 3, a tablet 2 with a lead-out end 1*b* of the coil 1 being placed along an outer side surface of a pillar-shaped convex portions 2*a* is loaded into the cavity so that the lead-out end 1*b* of the coil 1 is interposed between the pillar-shaped convex portions 2*a* of the tablet 2 and an inner wall of the sectional die 4*b*.

At this time, a side surface of the tablet 2, which is perpendicular to a side surface from which the lead-out end 1*b* of the coil 1 is led out, as well as parallel to a winding axis, protrudes from the cavity of the intended (predetermined) size of the molding die.

Figure 4:
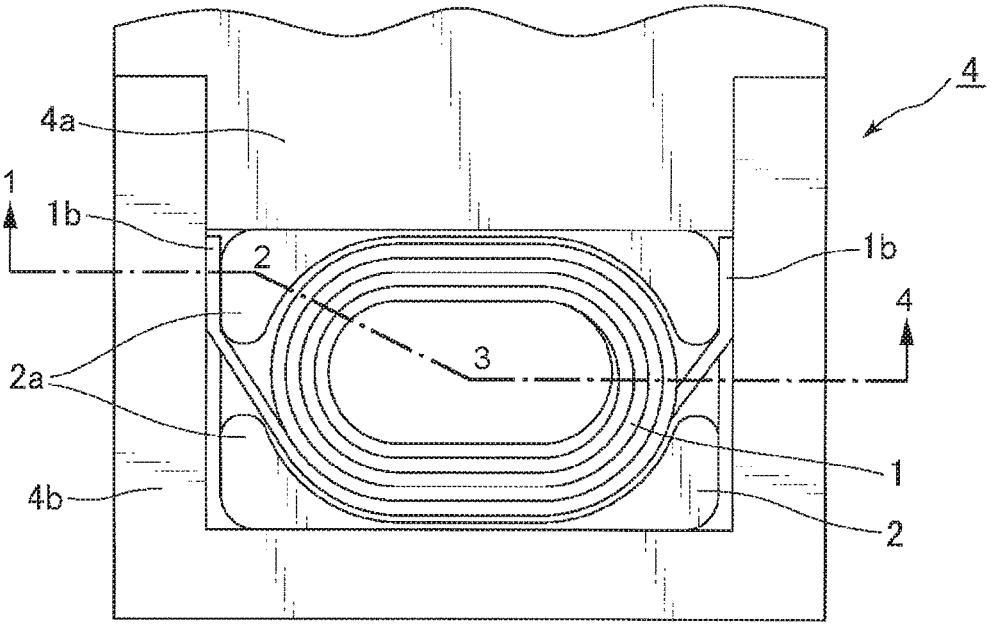
FIG. 4 is a top view explaining a first step of the first embodiment of the manufacturing method of a surface mounted inductor of the present disclosure.

Next, in a state in which the molding die is heated to a softening temperature of a sealing material or more, for example, to 60° C. to 130° C., as shown in FIG. 4, the sectional die 4*a* and the sectional die 4*b* are clamped. Thereby, an outer peripheral portion of the tablet 2 is softened, and two side surfaces of the tablet 2, which are each perpendicular to the side surface from which the lead-out end 1*b* of the coil 1 is led out, as well as each parallel to the winding axis, are pressurized, so that the tablet 2 is housed in the cavity of the intended size of the molding die 2. The molding die may also be pre-heated when the tablet 2 is loaded.

Figure 5:
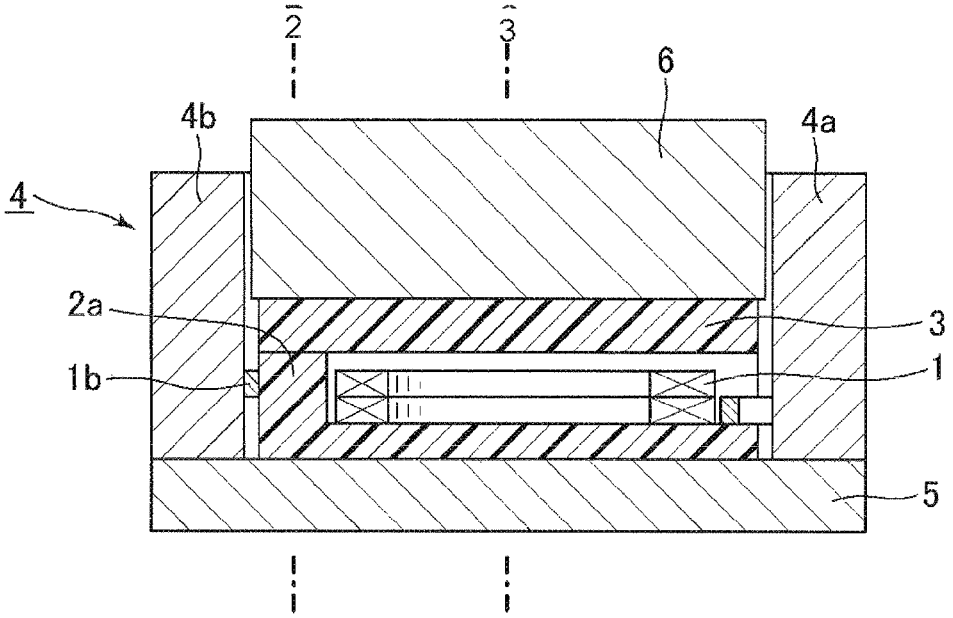
FIG. 5 is a cross-sectional view explaining the arrangement of the coil and the tablet in the molding die in a second step of the first embodiment of the manufacturing method of a surface mounted inductor of the present disclosure, and corresponds to the 1-2-3-4 combination cross-sectional view of FIG. 4.

Subsequently, as shown in FIG. 5, a tablet 3 formed into a plate shape is loaded into the cavity of the molding die, the punch 6 is set, and the molding die is pre-heated.

Figure 6:
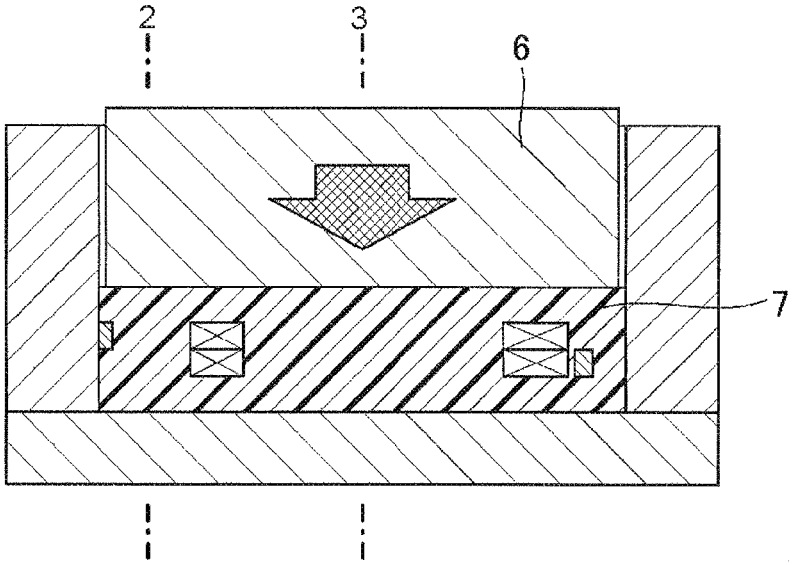
FIG. 6 is a cross-sectional view explaining the second step of the first embodiment of the manufacturing method of a surface mounted inductor of the present disclosure, and corresponds to the 1-2-3-4 combination cross-sectional view of FIG. 4.
Figure 7:
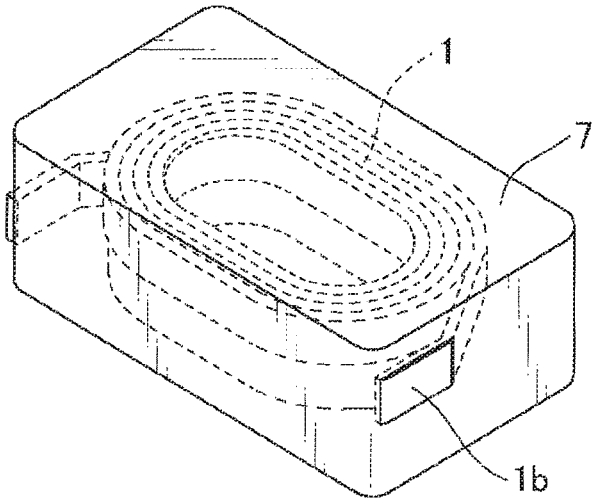
FIG. 7 is a perspective view showing an embodiment of a formed body according to the present disclosure.
Figure 8:
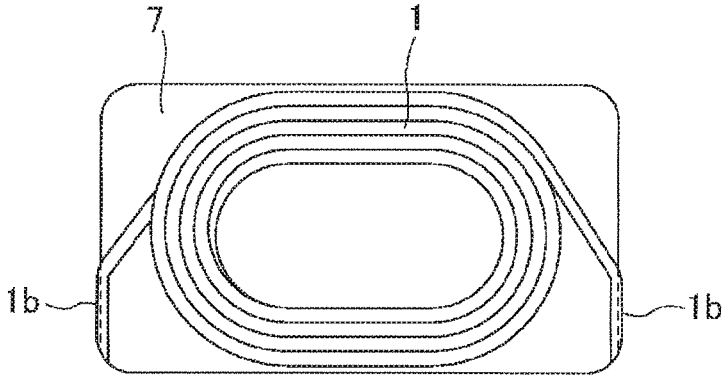
FIG. 8 is a top transparent view showing an embodiment of a formed body according to the present disclosure.

Furthermore, in a state in which the temperature of the molding die is raised to 100° C. to 220° C., for example, as shown in FIG. 6, a pressure is applied in a direction horizontal to the winding axis of the coil 1 using the punch 6 until the density of the metal magnetic powder reaches a predetermined density so that the tablet 2 and the plate-shaped tablet 3 are integrated, and the sealing material is cured. At this time, the tablet 2 and the plate-shaped tablet 3 are in a softened state in the cavity of the molding die, thus making it possible to easily seal the coil 1. The lead-out end 1*b* of the coil is sealed in a state of being at least partially embedded in the sealing material without any misalignment. A formed body 7 obtained by curing the sealing material is taken out from the molding die. As shown in FIG. 7, a plane of the lead-out end 1*b* of the coil is exposed on a surface of the formed body 7. As shown in FIG. 8, in this formed body, an outer peripheral portion of the coil 1 has almost the same area as or a smaller area than a core portion of the coil.

Figure 9:
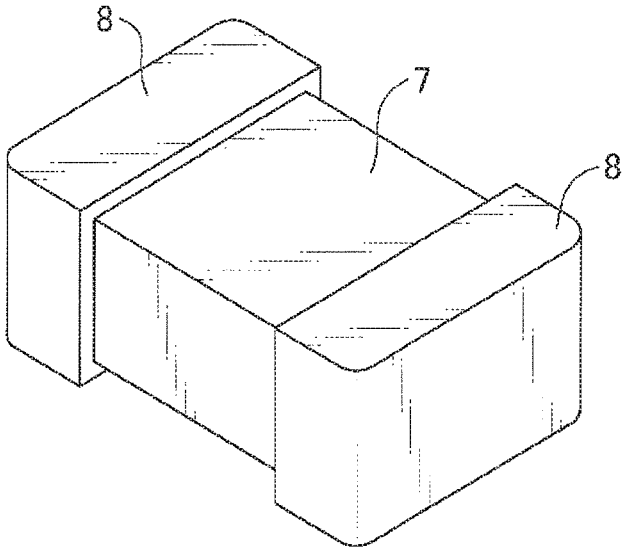
FIG. 9 is a perspective view showing an embodiment of a surface mounted inductor according to the present disclosure.

Lastly, a conductive resin is coated on surfaces of the formed body so that they are connected to the lead-out ends 1*b* of the coil 1 which are exposed on the surfaces of the formed body. Then plate processing is performed to form external electrodes 8, and a surface mounted inductor shown in FIG. 9 is obtained. The electrodes formed by plate processing may be selected from one or a plurality of Ni, Sn, Cu, Au, Pd and the like as necessary.

Second Embodiment

Figure 10:
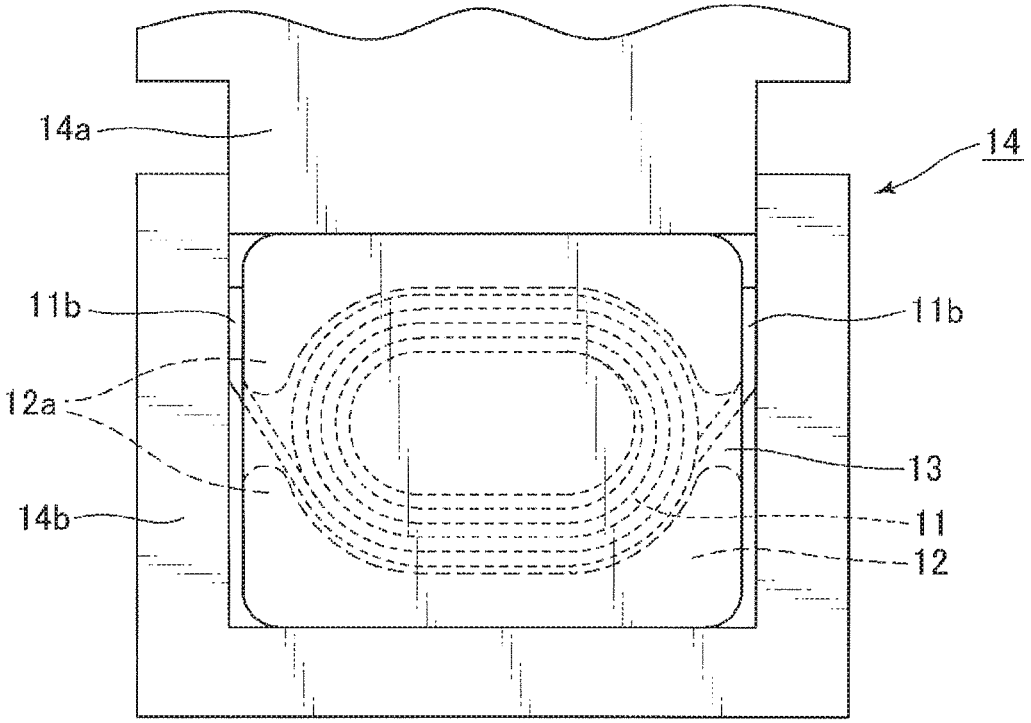
FIG. 10 is a top view showing the arrangement of a coil and a tablet in a molding die of a second embodiment of the manufacturing method of a surface mounted inductor of the present disclosure.

Such a surface mounted inductor may also be manufactured in the following manner. In the present embodiment, a molding die is used, in which a die 14 consisting of a sectional die 14*a* and a sectional die 14*b*, and a lower die (not shown) form a cavity, and which has a punch to be inserted into the cavity. First, in a state in which the sectional die 14*a* is removed or in a state in which the sectional die 14*a* is loosened as shown in FIG. 10, a tablet 12 on which a coil 11 is placed and a plate-shaped tablet 13 are loaded into the cavity. At this time, the tablet 12 on which the coil 11 is placed is loaded so that a lead-out end 11*b* of the coil 11 is interposed between a pillar-shaped convex portions 12*a* of the tablet 12 and an inner wall of the sectional die 14*b*. Side surfaces of each of the tablet 12 on which the coil 11 is placed and the tablet 13 are in a state in which they protrude from the cavity of the intended size of the molding die.

Figure 11:
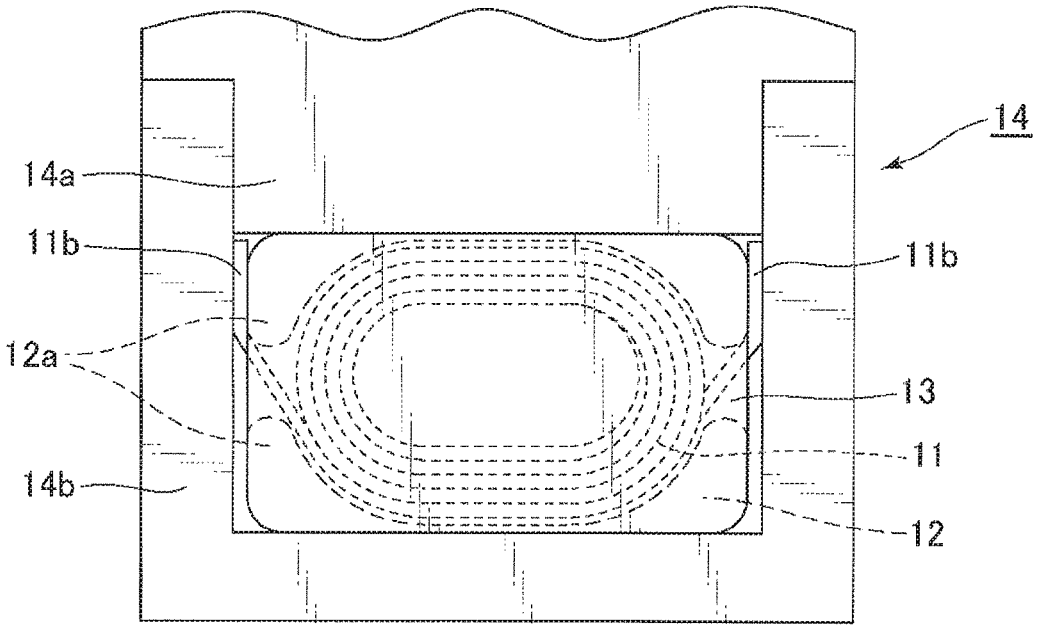
FIG. 11 is a top view explaining a first step of the second embodiment of the manufacturing method of a surface mounted inductor of the present disclosure.

Next, in a state in which the molding die is heated to a softening temperature of a sealing material or more, for example, to 60° C. to 130° C., as shown in FIG. 11, the sectional die 14*a* and the sectional die 14*b* are clamped. Thereby, outer peripheral portions of the tablet 12 on which the coil 11 is placed and the tablet 13 are softened. Together with that, two side surfaces of each of the tablets 12 and 13 are pressurized, so that the tablet 12 on which the coil 11 is placed and the tablet 13 are housed in the cavity of the intended size. The two side surfaces thereof are each perpendicular to the side surface from which the lead-out end 11*b* of the coil 11 is led out, as well as each parallel to the winding axis. The molding die may also be pre-heated when the tablet 12 on which the coil 11 is placed and the tablet 13 are loaded.

Subsequently, the punch (not shown) is set, and the molding die is pre-heated.

Furthermore, in a state in which the temperature of the molding die is raised to 100° C. to 220° C., for example, pressure is applied in a direction horizontal to the winding axis of the coil 11 using the punch 6 until the density of the metal magnetic powder reaches a predetermined density, so that the two tablets 12 and 13 are integrated, and the sealing material is cured. At this time, the two tablets are in a softened state in the cavity of the molding die, thus making it possible to easily seal the coil 11. The lead-out ends 11*b* of the coil 11 are sealed in a state of being at least partially embedded in the sealing material without any misalignment. A formed body obtained by curing the sealing material is taken out from the molding die. A plane of the lead-out end 11*b* of the coil 11 is exposed on a surface of the formed body. In this formed body, the outer peripheral portion of the coil 1 has almost the same area as or a smaller area than a core portion of the coil.

Lastly, a conductive resin is coated on surfaces of the formed body so that they are connected to the lead-out ends 11*b* of the coil 11 which are exposed on the surfaces of the formed body. Then plate processing is performed to form external electrodes, and a surface mounted inductor is obtained. The electrodes formed by plate processing may be selected from one or a plurality of Ni, Sn, Cu, Au, Pd and the like as necessary.

Modified Embodiment

The above has described the embodiments of the surface mounted inductors of the present disclosure, and the present disclosure is not limited to these embodiments. For example, the two sectional dies of the molding die may also be clamped when the molding die is pre-heated to the second temperature.

Figure 12:
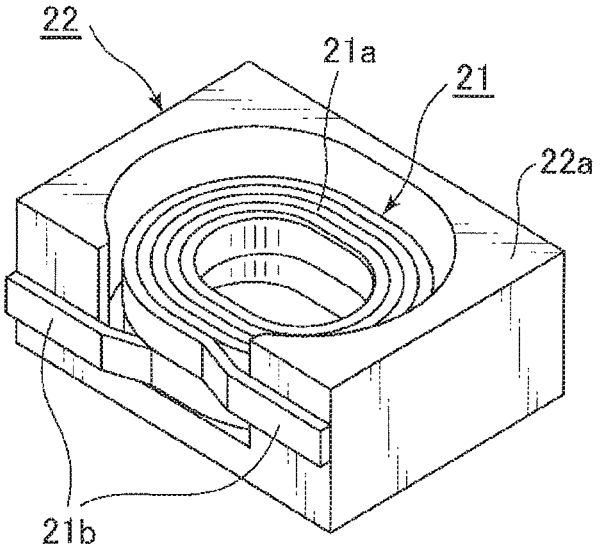
FIG. 12 is a perspective view showing the arrangement of a coil and a tablet on which the coil is placed, which are used for a third embodiment of the manufacturing method of a surface mounted inductor of the present disclosure.
Figure 13:
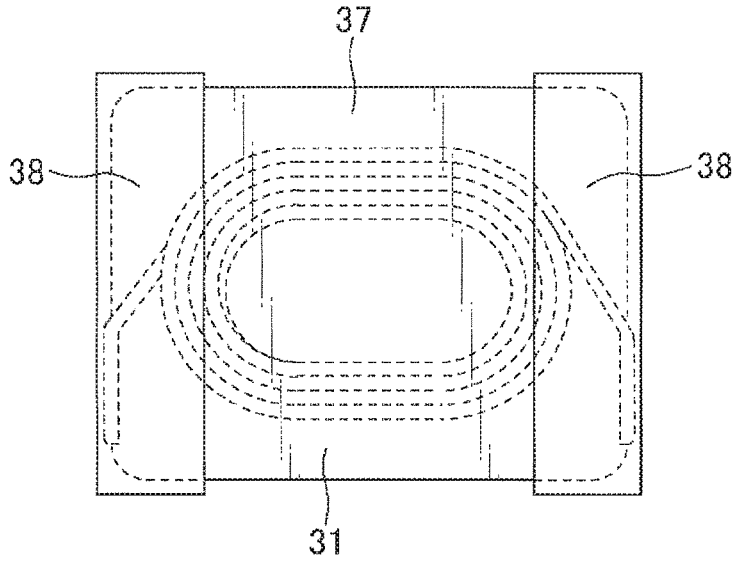
FIG. 13 is a top view of a conventional surface mounted inductor.
Figure 14:
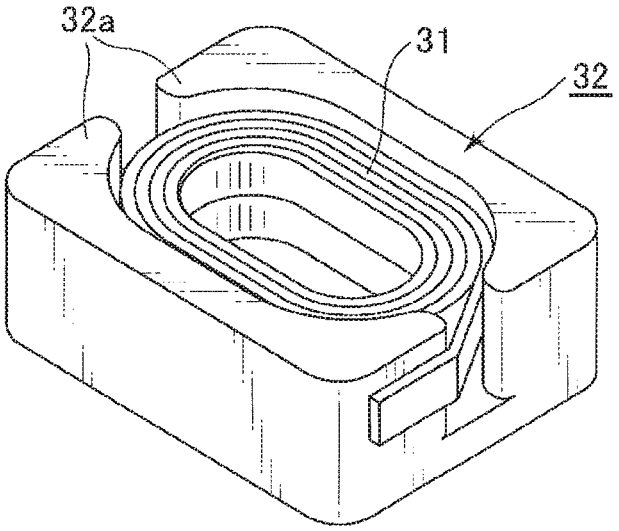
FIG. 14 is a perspective view of a tablet of the conventional surface mounted inductor.
Figure 15:
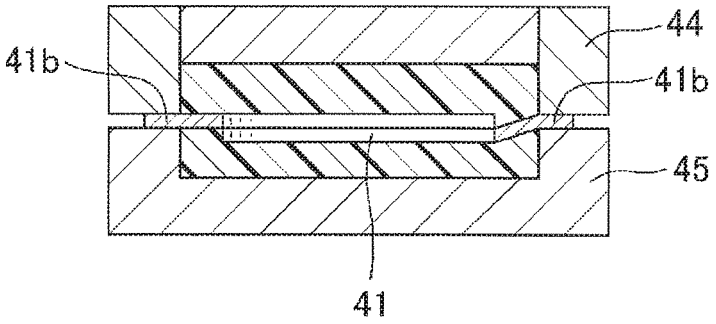
FIG. 15 is a cross-sectional view showing a manufacturing process of a conventional surface mounted inductor.

Also, as shown in FIG. 12, a coil and a tablet on which the coil is placed are formed in the following manner: A coil 21 obtained by winding a rectangular wire in two-tiers in an outside-to-outside manner serves as a wound portion 21*a*, and lead-out ends 21*b* are led out to the same side surface side. The tablet 22 has a positioning mechanism 22*a*, and may be formed so that a size in a direction perpendicular to a winding axis of the coil 21 is larger than the cavity in the molding die.

Furthermore, the molding die for compressing the distance between the two side surfaces of the tablet, which are each perpendicular to the side surface from which the lead-out end of the coil of the tablet is led out, as well as each parallel to the winding axis, to the size of the cavity in the molding die, and the molding die for pressurizing the two tablets in the direction horizontal to the winding axis of the coil to integrate them, and curing the sealing material may be separate dies.

The invention claimed is:

1. A manufacturing method of a surface mounted inductor obtained by sealing a coil with a sealing material containing a resin and a filler using at least one molding die, the method comprising:

a first step in which, using a coil formed by winding a conductive wire so that lead-out ends are positioned at an outer periphery of a wound portion, and a tablet having a positioning mechanism and formed so that a size in one direction perpendicular to a winding axis of the coil is larger than a cavity in the at least one molding die, the coil is placed on the tablet, the coil and the tablet are arranged in the molding die so that one of the lead-out ends of the coil is placed along an outer side surface of the tablet to be interposed between the outer side surface of the tablet and an inner wall surface of the at least one molding die, and a portion of the tablet, which is formed larger than the cavity in the at least one molding die, is pressurized and compressed to the size of the cavity in the at least one molding die at a first temperature; and a second step in which the coil and the tablet are pressurized in the at least one molding die at a second temperature higher than the first temperature to form a formed body incorporating the coil, wherein, in the first step, after another tablet is placed on the tablet on which the coil is placed, portions of the tablets, which are each formed larger than the cavity in the at least one molding die, are pressurized and compressed to the size of the cavity in the at least one molding die at the first temperature.

2. The manufacturing method of a surface mounted inductor according to claim 1, wherein, in the second step, the portions of the tablets are pressurized in a direction horizontal to the winding axis of the coil in the at least one molding die.

3. The manufacturing method of a surface mounted inductor according to claim 1, wherein the at least one molding die used in the first step and the at least one molding die used in the second step are the same.

4. The manufacturing method of a surface mounted inductor according to claim 1, wherein the at least one molding die used in the first step and the at least one molding die used in the second step are different.

5. A manufacturing method of a surface mounted inductor obtained by sealing a coil with a sealing material containing a resin and a filler using at least one molding die, the method comprising:

a first step in which, using a coil formed by winding a conductive wire so that lead-out ends are positioned at an outer periphery of a wound portion, and a tablet having a positioning mechanism and formed so that a size in one direction perpendicular to a winding axis of the coil is larger than a cavity in the at least one molding die, the coil is placed on the tablet, the coil and the tablet are arranged in the molding die so that one of the lead-out ends of the coil is placed along an outer side surface of the tablet to be interposed between the outer side surface of the tablet and an inner wall surface of the at least one molding die, and a portion of the tablet, which is formed larger than the cavity in the at least one molding die, is pressurized and compressed to the size of the cavity in the at least one molding die at a first temperature; and a second step in which the coil and the tablet are pressurized in the at least one molding die at a second temperature higher than the first temperature to form a formed body incorporating the coil, wherein, in the second step, after another tablet is placed on the coil and the tablet obtained in the first step, the tablets are pressurized in the at least one molding die at the second temperature higher than the first temperature to form a formed body incorporating the coil.

6. The manufacturing method of a surface mounted inductor according to claim 5, wherein, in the second step, the tablets are pressurized in a direction horizontal to the winding axis of the coil in the at least one molding die.

7. The manufacturing method of a surface mounted inductor according to claim 5, wherein the at least one molding die used in the first step and the at least one molding die used in the second step are the same.

8. The manufacturing method of a surface mounted inductor according to claim 5, wherein the at least one molding die used in the first step and the at least one molding die used in the second step are different.

9. A manufacturing method of a surface mounted inductor obtained by sealing a coil with a sealing material containing a resin and a filler using at least one molding die, the method comprising:

a first step in which, using a coil formed by winding a conductive wire so that lead-out ends of the coil are positioned at an outer periphery of a wound portion, and a tablet having a positioning mechanism and formed so that a distance between two side surfaces, which are each perpendicular to a side surface from which one of the lead-out ends of the coil is led out, as well as each being parallel to a winding axis, is larger than a cavity in the at least one molding die, the coil is placed on the tablet, the coil and the tablet are arranged in the at least one molding die so that the one lead-out end of the coil is placed along an outer side surface of the tablet to be interposed between the outer side surface of the tablet and an inner wall surface of the at least one molding die, and the two side surfaces of the tablet, which are each perpendicular to the side surface from which the one lead-out end of the coil is led out, as well as each being parallel to the winding axis, are pressurized and compressed at a first temperature so that the distance between the two side surfaces, which are each perpendicular to the side surface from which the one lead-out end of the coil is led out, as well as each being parallel to the winding axis, is compressed to the size of the cavity in the at least one molding die; and a second step in which the coil and the tablet are pressurized in the at least one molding die at a second temperature higher than the first temperature to form a formed body incorporating the coil, wherein, in the second step, after another tablet is placed on the coil and the tablet obtained in the first step, the tablets are pressurized in the at least one molding die at the second temperature higher than the first temperature to form a formed body incorporating the coil.

10. The manufacturing method of a surface mounted inductor according to claim 9, wherein, in the second step, the tablets are pressurized in a direction horizontal to the winding axis of the coil in the at least one molding die.

11. The manufacturing method of a surface mounted inductor according to claim 9, wherein the at least one molding die used in the first step and the at least one molding die used in the second step are the same.

12. The manufacturing method of a surface mounted inductor according to claim 9, wherein the at least one molding die used in the first step and the at least one molding die used in the second step are different.

* * * * *